United States Patent [19]

Skaadel et al.

[11] 4,191,229

[45] Mar. 4, 1980

[54] FLEXIBLE CONTAINER FOR TRANSPORTATION AND STORAGE OF BULK MATERIALS

[75] Inventors: Johannes Skaadel, Skien; Bjarne Omdal, Porsgrunn, both of Norway

[73] Assignee: Norsk Hydro A.S., Oslo, Norway

[21] Appl. No.: 959,778

[22] Filed: Nov. 13, 1978

Related U.S. Application Data

[63] Continuation-in-part of Ser. No. 810,473, Jun. 27, 1977, Pat. No. 4,136,723.

[30] Foreign Application Priority Data

Jun. 28, 1976 [NO] Norway ..... 762230

[51] Int. Cl.[2] ..... B65D 29/00

[52] U.S. Cl. ..... 150/1; 229/57

[58] Field of Search ..... 150/1, 12; 229/54 R, 229/57, 58

[56] References Cited

U.S. PATENT DOCUMENTS

| | | | |
|---|---|---|---|
| 2,196,185 | 4/1940 | Belcher | 229/54 R |
| 3,001,207 | 9/1961 | Nail | 150/1 X |
| 4,010,784 | 3/1977 | Nattrass | 150/1 |

*Primary Examiner*—George T. Hall

*Attorney, Agent, or Firm*—Wenderoth, Lind & Ponack

[57] ABSTRACT

A single elongated piece of material has a major longitudinal dimension and is folded along plural fold lines extending transverse to the major longitudinal dimension, thereby forming plural wall sections and plural bottom sections. The plural bottom sections are overlapped to form a plural ply bottom of the container. The wall sections are lined with edges thereof being juxtaposed, and at least portions of the juxtaposed edges are joined to form corner edges of the container. Certain of the fold lines form an upper portion of the container. Longitudinally opposite free end edges of the piece of material are joined. The edges of the bottom sections which extend transverse to the fold lines are free and substantially unattached.

8 Claims, 4 Drawing Figures

FLEXIBLE CONTAINER FOR TRANSPORTATION AND STORAGE OF BULK MATERIALS

This is a continuation-in-part of application Ser. No. 810,473, filed June 27, 1977, now U.S. Pat. No. 4,136,723.

BACKGROUND OF THE INVENTION

The present invention relates to a flexible container for the transportation and storage of bulk material, especially free-flowing pulverulent or granular material. The invention also relates to a method for manufacturing such flexible container.

Today there are several known types of containers for transportation of free-flowing bulk material. Some are of the one-trip type and others are intended to be used several times. Such containers are usually called Intermediate Bulk Containers.

Swedish patent application Ser. No. 7405935 describes a flexible container which can be lifted when filled. This container is provided with a special lifting device which comprises a rope, one end of which is secured to the container top. The other end of the rope runs through the center of the container and is secured at the container bottom, for instance to a plate below the container bottom. In this way the stress is better distributed when the container is lifted. Although this lifting device distributes the stress somewhat better than do conventional flexible containers, its construction is rather complicated, thus increasing the cost of manufacturing the container. Another drawback is that the container is made of a number of different components, and the total quantity of material per container is large.

Further, Danish Pat. No. 132,877 describes a flexible container having a squarish bottom section with a discharge opening that is covered by a loose piece of material. This piece is cut before discharging. Before refilling the container, a new cover-piece is placed in it. The container is equipped with four specially fastened lifting loops, and its upper section has a special lid with a filling opening that can be closed. This rather complicated container which consists of several components that have to be joined together, requires a complicated and thus expensive manufacturing apparatus, and accordingly the cost of the container is made expensive. Such a container is consequently intended to be used several times. The four separately fastened loops result in an uneven distribution of the vertical stresses in the container's fabric which thus must be made from strong and expensive material.

The present invention is the result of further development of the flexible container according to Norwegian patent application No. 4350/73, corresponding to British Pat. No. 1,475,019. This container is made from a single piece of material that is folded and sewn together along its sides and bottom. Approximately at the middle of the folded edge there is a slit which constitutes the filling opening of the container. The side seams terminate some distance from the folded edge thus providing to lifting loops which extend from the slit to the point of intersection between the imaginary extension lines of the side seams and the folded edge.

The container has proved to be well suited for transportation of bulk material. It is cheap and can therefore be used as a one-trip container. However, by destructive, dynamic testing it has been found that the stress distribution during lifting of the container is not optimal due to the design of the bottom of the container.

SUMMARY OF THE INVENTION

With the above discussion in mind, an object of the present invention is to provide an improved container and method for the manufacture thereof which overcome the disadvantages of the above discussed prior art containers.

This object is achieved according to the present invention by the formation of a flexible container for the transportation and storage of bulk material, wherein the container is formed from a single elongated piece of material, for example an elongated rectangular piece of material, having a major longitudinal dimension. The piece of material is folded along plural fold lines extending transverse to the major longitudinal dimension, thereby forming plural wall sections and plural bottom sections. The plural bottom sections are overlapped to form a plural ply container bottom. The wall sections are aligned with edges thereof juxtaposed, and at least portions of the juxtaposed edges of the wall sections are joined, for example by sewing, to form corner edges of the container. Certain of the fold lines form an upper portion of the container. Opposite longitudinally free end edges of the piece of material are joined. Lateral edges of the bottom sections which extend transverse to the fold lines are maintained free and substantially unattached, that is such lateral edges are not joined or sewn to other sections.

In accordance with a further feature of the present invention, the upper portions of the juxtaposed edges of the wall sections are not joined and thereby cooperate with the fold lines which form the upper portion of the container to form lifting loops and a central filling opening for the container.

In accordance with a specifically preferred embodiment of the invention, the single piece of material is folded to include four wall sections, to include a longitudinally central portion which forms a first bottom section of the container, and to form opposite end portions which are joined to form a second bottom section of the container.

In accordance with a modified embodiment of the invention, the single piece of material is folded to form a first bottom section which is positioned between, but not centrally between, opposite ends of the piece of material, and the second bottom section is formed from a single end portion at one end only of the single piece of material.

The flexible container according to the invention may be made from any flexible material as is customary in the art, for example woven polypropylene.

An important feature of the present invention is that the bottom of the container is formed in plural plies of plural bottom sections, with only certain of the opposite edges of the bottom sections being joined or integral with the wall sections, and with the remaining opposite edges of the bottom sections being free and substantially unattached to the wall sections. This results in a particularly good stress distribution because the overlapping bottom sections forming the container bottom can shift somewhat relative to each other, thereby forming a stronger bottom than in a container employing a bottom formed of only one integral piece of material. Additionally, since the container bottom according to the present invention has plural plies, the load on any bottom seams is accordingly reduced.

The flexible container discussed in more detail below is illustrated as being formed with four walls and thus having a substantially square-shaped bottom. However, it is to be understood that the flexible container could be made to have a greater number of side walls, for example six or eight side walls, with a corresponding increase in plies of the container bottom.

The container of the present invention may be employed for transporting or storing bulk material in quantities from 100 kgs up to several tons. The container can be made from fabrics, for instance woven polypropylene, from plastic material or from paper. The construction of the container according to the invention is independent of the container material, as long as the material is suitable for the intended container. The container of the present invention may be fitted with an inner bag of an impervious material, for instance plastic or paper. The container of the invention includes a bottom, a middle section formed by side walls, and an upper section having lifting loops strong enough to allow the filled container to be lifted. The lifting loops are formed integrally with the side walls of the container itself.

BRIEF DESCRIPTION OF THE DRAWINGS

Other objects, features and advantages of the present invention will be apparent from the following detailed description, taken with the accompanying drawings, wherein.

DETAILED DESCRIPTION OF THE INVENTION

Figure 1:
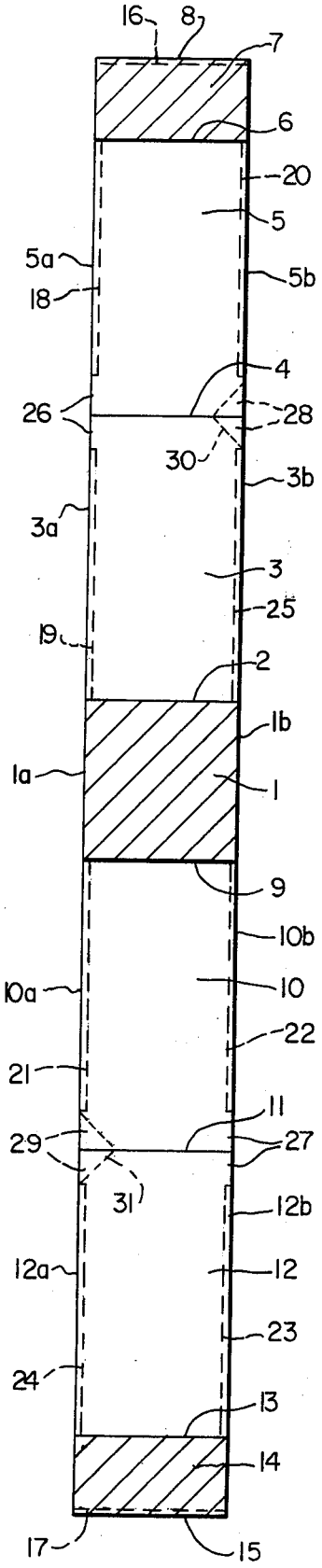
FIG. 1 is an elevation view illustrating a flattened single piece of material which may be used to form a flexible container in accordance with one embodiment of the present invention.
Figure 2:
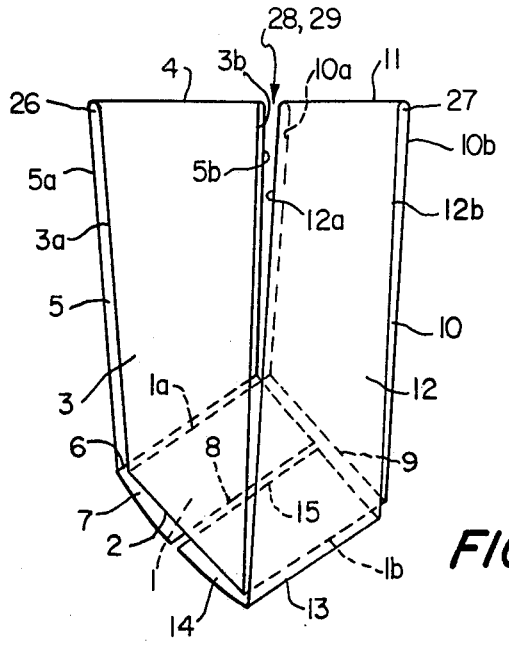
FIG. 2 is a perspective view, somewhat unattached or exploded, illustrating a flexible container formed with the single piece of material illustrated in FIG. 1.

With reference to FIGS. 1 and 2 of the drawings, a first embodiment of the present invention will be described in detail.

Specifically, the flexible container illustrated in FIG. 2 can be made from a single piece of material such as illustrated in FIG. 1. The piece of material has a major longitudinal dimension, i.e. the vertical dimension in FIG. 1. The piece of material may be folded along plural fold lines extending transverse to the major longitudinal dimension to thereby form plural wall sections and plural bottom sections. The drawings illustrate a piece of material folded in a manner to form a flexible container having four walls and a double ply bottom. The scope of the present invention however encompasses flexible containers formed to have more than four walls, for example six or eight walls, and a bottom having a corresponding increased number of plies.

In FIG. 1, there are shown fold lines 6, 4, 2, 9, 11 and 13 to thereby form four wall sections 5, 3, 10 and 12. There are also formed a first bottom section 1 and a second bottom section formed by opposite end portions 7 and 14 of the single sheet of material.

In FIG. 1, the bottom sections 1, 7 and 14 are shown shaded merely to illustrate the manner of folding the piece of material to form the flexible container shown in FIG. 2. Specifically, the shaded surfaces of the bottom sections shown in FIG. 1 will appear as the lower surfaces of the bottom sections of the container bottom shown in FIG. 2.

With further attention now to FIG. 2 of the drawings, the piece of material is folded at fold lines 2 and 9 to form upper inner bottom section 1 and wall sections 3 and 10 extending upwardly therefrom. The pieces of material are further folded at 4 and 11 to form additional wall sections 5 and 12 extending downwardly therefrom. Wall sections 5 and 12 are folded at the bottom portions thereof at fold lines 6 and 13, respectively, such that end portions 7 and 14 fit beneath first bottom section 1 to form a second bottom section which is formed by joining opposite end edges 8 and 15, for example by sewing.

Attention is directed to the fact that in the drawings, the sew lines are shown in FIG. 1. However, the sew lines are omitted from FIG. 2, and also the edges thereof which are joined are shown as slightly separated, for purposes of clarity of illustration.

Juxtaposed side edges of the wall sections are joined together, for example by sewing, to form substantially vertically extending corner edges of the container.

For example, edge **3*a* of wall section 3 is joined to edge 5*a* of wall section 5 to form one corner edge. Edge 5*b* of wall section 5 is joined to edge 10*a* of wall section 10 to form a further corner edge. Edge 10*b* of wall section 10 is joined to edge 12*b* of wall section 12 to form a third corner edge. Finally, edge 12*a* of wall section 12 is joined to edge 3*b* of wall section 3 to form a fourth corner edge. This joining may be for example by sewing or by other known means. FIG. 1 illustrates sewing edges achieved to join the above noted wall edges to form the corner edges. That is, sewing lines 18 and 19 together form a first corner edge of the container. Sewing lines 20 and 21 together form a second corner edge of the container. Sewing lines 22 and 23 together form a third corner edge of the container. Sewing lines 24 and 25** together form a fourth corner edge of the container.

In accordance with a further feature of the present invention, the upper portion of the container is formed by fold lines 4 and 11, and the upper portions of the juxtaposed edges of the wall sections may be left unjoined to thereby cooperate with the fold lines 4 and 11 to form lifting loops and a central filling opening for the container. More particularly, sewing lines 18 and 19 terminate before fold line 4, thereby leaving an unjoined portion 26 to form a first lifting loop. Similarly, sewing lines 22 and 23 are terminated before fold line 11, thereby leaving an unjoined area 27 which operates to form a second lifting loop.

Yet further, sewing lines 20 and 25 may be terminated before fold line 4, thereby forming an unjoined area 28, and sewing lines 21 and 24 may be terminated before fold line 11, thereby forming a further unjoined area 29. Unjoined areas 28 and 29 cooperate to form a central filling opening in the center portion of the upper part of the container. To facilitate ease in filling bulk material into the container, portions 30 and 31 may be cut away as shown in dashed lines in FIG. 1, thereby forming an enlarged central filling opening.

In the embodiment of FIGS. 1 and 2 of the drawings, first bottom section 1 is located longitudinally centrally between opposite end edges 8 and 15 of the piece of material, and the second bottom section of the container is jointly formed by end portions 7 and 14 provided in opposite ends of the piece of material.

Figure 3:
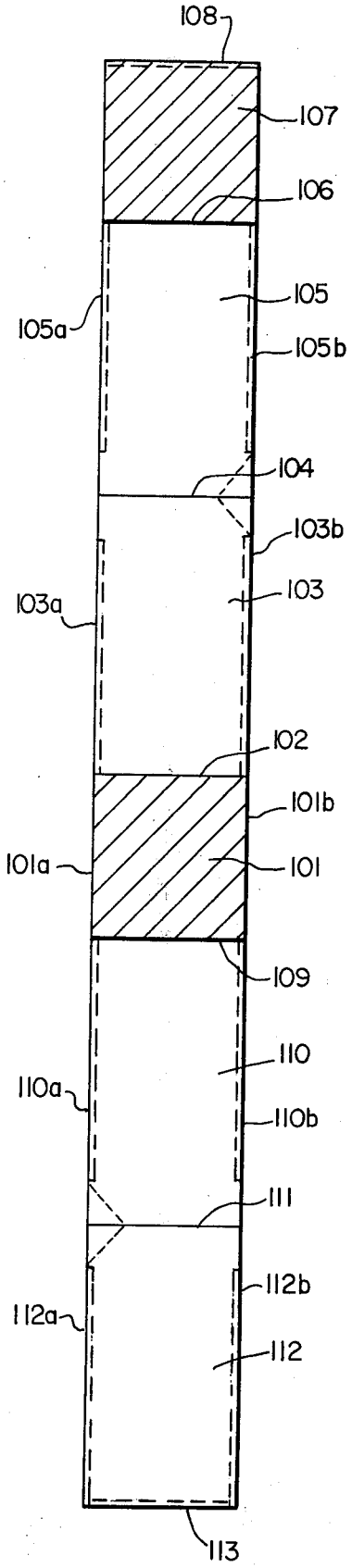
FIG. 3 is a view similar to FIG. 1, but illustrating a slightly modified single piece of material which may be employed to form a flexible container in accordance with a second embodiment of the present invention.
Figure 4:
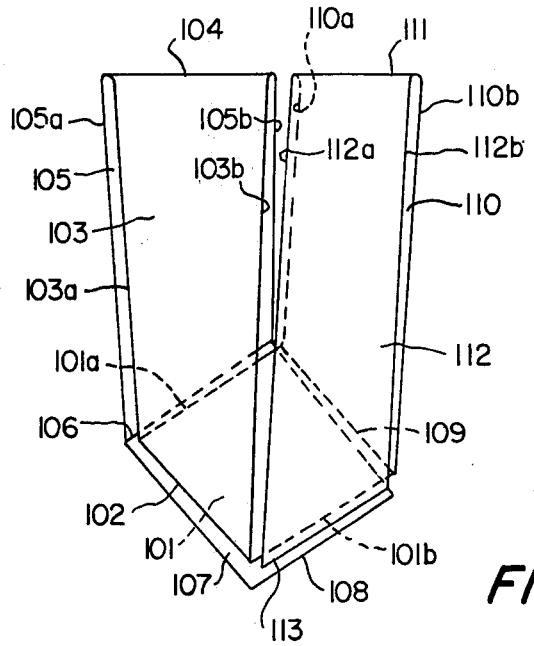
FIG. 4 is a view similar to FIG. 2, but illustrating a flexible container formed from the single piece of material illustrated in FIG. 3.

However, in the modified embodiment of the present invention illustrated in FIGS. 3 and 4 of the drawings, the first bottom section 101, although located between the opposite end edges 108 and 113 of the piece of material, is not located longitudinally centrally thereof, but rather is somewhat offset from the center thereof. Further, the second bottom section 107 is formed at only a single end portion of the piece of material.

Thus, when the piece of material is folded in the manner described above to form the flexible container illustrated in FIG. 4, end edge 108 of second bottom section 107 is joined, for example by sewing, to the bottom edge 113 of wall section 112. This embodiment of the present invention is in all other respects identical to the embodiment described above in detail with reference to FIGS. 1 and 2 of the drawings, and therefore the embodiment of FIGS. 3 and 4 will not be further described in detail.

An important feature of the present invention is that the lateral edges of the bottom sections which extend transverse to the fold lines are free and substantially unattached to other sections of the container. That is, with reference to FIGS. 1 and 2 of the drawings, free edges 1*a* and 1*b* of first bottom section 1 remain free and unattached to any other sections or portions of the container. That is, as shown in FIG. 2, edges 1*a* and 1*b* are not attached, for example by sewing, to any of the wall sections or any other portions of the container. Similarly, in the embodiment of FIGS. 3 and 4, lateral edges 101*a* and 101*b* of first bottom section 101 remain unattached to any of the wall sections or other portions of the container. It will be readily apparent that the free lateral edges of the second bottom section (7 and 14 in FIGS. 1 and 2 and 107 in FIGS. 3 and 4) remain free and unattached to any of the wall sections or other portions of the container.

Although in the above described embodiments, the lateral edges of the bottom sections which extend transverse to the fold lines are completely free and unattached to other sections of the container, it is intended to be within the scope of the present invention that such lateral edges could be weakly attached to other sections of the container. Such weak attachment would however be only of an extent to prevent spillage of bulk material from the container and would not be a connection which would be sufficient in any way to form a structural joining of the lateral edges with other portions of the container. That is, in the event that the lateral edges of the bottom sections were to be weakly joined, such joining must be loose enough to still maintain the good stress distribution between the overlapping bottom sections so that the plies of the bottom can shift relative to one another.

In the illustrated embodiments, the first bottom section, i.e. bottom sections 1 and 101 which are located between the opposite ends of the single piece of material, is the uppermost and innermost bottom section of the container bottom, whereas the second bottom, i.e. the bottom section formed by end portions 7 and 14 in FIGS. 1 and 2 and 107 in FIGS. 3 and 4, is the lowermost and outermost ply of the container bottom. However, it is to be understood to be within the scope of the present invention that this arrangement can be reversed, such that the first bottom section 1 or 101 may be the lowermost and outermost ply of the container bottom.

The flexible container according to the present invention is stronger than conventional previously known containers, may be made by a simpler method than previously known containers, and requires less material than previously known containers.

It will be apparent that various modifications of the above described specific structural arrangements and operations may be made without departing from the scope of the present invention.

What we claim is:

1. A flexible container for transportation and storage of bulk material, said container comprising:

a single elongated piece of material having a major longitudinal dimension;

said piece of material being folded along plural fold lines extending transverse to said major longitudinal dimension, thereby forming plural wall sections and plural bottom sections, such that said plural bottom sections are overlapped to form a plural ply bottom of said container, and such that said wall sections are aligned with edges thereof juxtaposed;

at least portions of said juxtaposed edges of said wall sections being joined to form corner edges of said container;

certain of said fold lines forming an upper portion of said container;

opposite longitudinally free end edges of said piece of material being joined; and edges of said bottom sections which extend transverse to said fold lines being free and substantially unattached.

2. A flexible container as claimed in claim 1, wherein upper portions of said juxtaposed edges of said wall sections are unjoined, thereby cooperating with said certain fold lines to form lifting loops and a central filling opening for said container.

3. A flexible container as claimed in claim 1, including four said wall sections, and wherein a longitudinally central portion of said single piece of material forms a first bottom section of said container, and opposite end portions of said single piece of material are joined to form a second bottom section of said container.

4. A flexible container as claimed in claim 3, wherein said first bottom section is the upper, inner bottom section of said container.

5. A flexible container as claimed in claim 3, wherein said second bottom section is the upper, inner bottom section of said container.

6. A flexible container as claimed in claim 1, including four said wall sections, and wherein a portion of said single piece of material between opposite ends thereof forms a first bottom section of said container, one end portion of said single piece of material forms a second bottom section of said container, and said longitudinally free end edges of said piece of material comprising a free edge of said second bottom section and a free bottom edge of one of said wall sections.

7. A flexible container as claimed in claim 6, wherein said first bottom section is the upper, inner bottom section of said container.

8. A flexible container as claimed in claim 6, wherein said second bottom section is the upper, inner bottom section of said container.

* * * * *